US005389940A

United States Patent [19]

Sutherland

[11] Patent Number: 5,389,940

[45] Date of Patent: Feb. 14, 1995

[54] ANTENNA POINTING MECHANISM

[75] Inventor: Colin A. Sutherland, Nepean, Canada

[73] Assignee: CAL Corporation, Ottawa, Canada

[21] Appl. No.: 944,278

[22] Filed: Sep. 14, 1992

[51] Int. Cl.[6] ..... H01Q 3/00

[52] U.S. Cl. ..... 343/765; 343/705; 343/766

[58] Field of Search ..... 343/765, 766, 705, 882, 343/895, 708, 878, 703; 248/183

[56] References Cited

U.S. PATENT DOCUMENTS

| | | | |
|---|---|---|---|
| 2,740,962 | 4/1956 | Hammond, Jr. | 343/766 |
| 3,789,414 | 1/1974 | Bauer et al. | 343/761 |
| 4,304,381 | 12/1981 | Lloyd | 343/765 |
| 4,442,435 | 4/1984 | Kiryu et al. | 343/765 |
| 4,490,724 | 12/1984 | Brickman | 343/765 |
| 4,920,350 | 4/1990 | McGuire et al. | 343/766 |
| 4,968,983 | 11/1990 | Maeda | 343/703 |
| 4,980,697 | 12/1990 | Eklund | 343/882 |
| 5,025,262 | 6/1991 | Abdelrazik et al. | 343/765 |
| 5,227,806 | 7/1993 | Eguchi | 343/765 |

FOREIGN PATENT DOCUMENTS

| | | |
|---|---|---|
| 890264 | 2/1962 | United Kingdom . |
| 2251982A | 7/1992 | United Kingdom . |

*Primary Examiner*—Donald Hajec

*Assistant Examiner*—Tan Ho

*Attorney, Agent, or Firm*—Pascal & Associates

[57] ABSTRACT

An antenna pointing mechanism for a highly directional antenna which avoids the aforenoted problems. The mechanism including the antenna are rendered substantially immune to bending and play-induced movements resulting from vibration or the like, making it highly useful for land based vehicles, ships, and particularly for aircraft. It also provides the ability to point the antenna over elevational angles exceeding 180°, making it particularly useful for communication with satellites from aircraft. The antenna pointing mechanism is comprised of a directional antenna having a central axis, first apparatus for supporting the antenna about a pitch axis which is orthogonal to the central axis and which passes through about the center of mass of the antenna, an electromagnetically transparent yoke surrounding the antenna for supporting the first apparatus, apparatus for rotatably retaining the yoke apparatus at opposite ends thereof at positions along a roll axis, first independent substantially electromagnetically transparent driving apparatus for driving the yoke to rotate about the pitch axis, and second independent substantially electromagnetically transparent driving apparatus for driving the antenna to rotate about the pitch axis.

20 Claims, 5 Drawing Sheets

ANTENNA POINTING MECHANISM

FIELD OF THE INVENTION

This invention relates to mechanisms for steering mobile directional antennae used for communication with satellites or other spacecraft.

BACKGROUND TO THE INVENTION

Highly directional steerable antennae for communication with earth satellites are required for such applications as communications for ships, aircraft and vehicles. While many designs exist to steer antennae, a particular antenna pointing problem exists in steering such antennae when carried by aircraft. This problem results from the aircraft flying high above the earth, resulting in the antennae having to point in a direction having a downward component in some circumstances, such as when the aircraft is banking, or when the aircraft is to communicate with another which is at a lower elevation, in contrast to earth-bound vehicles in which the antennae need be steered over an angle not exceeding 180°, and usually over a much smaller angle.

Particularly when carried by an aircraft, the effect on the antenna of vibration and externally applied forces from any angle can affect the pointing direction of the antenna due to the effects of play and bending caused by angular momentum on the elements of the antenna. This can have severe consequences. For example, when an aircraft is experiencing turbulence and when a small highly directional antenna carried by it is locked onto a satellite for transmission or reception of communication data, antenna lock-on to the satellite can be lost. A similar problem can be experienced when the antenna is being carried at sea and a boat carrying it experiences rough water, or by a terrestrial vehicle being driven over a rough (e.g. washboard or pot-holed and/or mountainous) road. In such cases antenna driving motors continuously work to move the antenna and orient it to constantly point at the satellite. A momentum-induced deflection of the antenna can cause it to unlock from the satellite from a position which the driving computers would expect to be a correct position, and which would thus cause a complete reinitialization scan to occur. This is time consuming and maintains an undesirable broken communications condition during the scan.

Patents which describe antenna orienting mechanisms all of which suffer from the aforenoted problems are as follows: U.S. Pat. Nos. 4,454,515, 4,980,697, 5,091,733, 4,251,819, 4,379,297, Canadian Patents 1,223,340, 1,165,435 and Canadian patent publication 2,005,426.

SUMMARY OF THE INVENTION

The present invention is an antenna pointing mechanism for a highly directional antenna which avoids the aforenoted problems. The mechanism including the antenna is rendered substantially immune to bending and play-induced movements resulting from vibration or the like, making it highly useful for land based vehicles, ships, and particularly for aircraft. It also provides the ability to point the antenna over elevational angles exceeding 180°, making it particularly useful for communication with satellites from aircraft.

In accordance with the present invention, an antenna pointing mechanism is comprised of a directional antenna having a central axis, first apparatus for supporting the antenna about a pitch axis which is orthogonal to the central axis and which passes through about the center of mass of the antenna, an electromagnetically transparent yoke surrounding the antenna for supporting the first apparatus, apparatus for rotatably retaining the yoke apparatus at opposite ends thereof at positions along a roll axis, first independent substantially electromagnetically transparent driving apparatus for driving the yoke to rotate about the pitch axis, and second independent substantially electromagnetically transparent driving apparatus for driving the antenna to rotate about the pitch axis.

Preferably the antenna is an elongated helical antenna, having axles for supporting it about a pitch axis which extends through approximately the center of mass of the antenna.

U.S. Pat. No. 3,158,866 describes a structure which supports an omnidirectional "rabbit ears" antenna above a platform which is supported from axles passing through a horse shoe-shaped yoke, which yoke is supported adjacent the top of a post. The yoke can be rotated about a roll axis passing through the point of support on the post and rotated about a pitch axis passing through the platform of the rabbit ears. If this design were used to communicate with a satellite when being supported by an aircraft encountering turbulence or experiencing vibration, the weight of the antenna elements would cause their rotation about the pitch axis due to the effects of momentum, and the horse shoe-shaped yoke would bend due to the weight of the antenna and its platform. The structure described in that patent is thus unsuitable and could not be used to provide the result achieved by the present invention.

BRIEF INTRODUCTION TO THE DRAWINGS

A better understanding of the invention will be obtained by reference to the detailed description below, in conjunction with the following drawings, in which:

FIG. 1 is the side view of an aircraft for carrying the present invention,

FIG. 1A is a set of axes illustrating orientation of an antenna as provided by the present invention, FIG. 2 is a side view of an embodiment of the present invention, FIG. 3 is a top view of an embodiment of the present invention, FIG. 4A, 4B and 4C are end, side and top views of relevant elements of an alternative pitch drive mechanism, FIGS. 5A, 5B and 5C are end, side and top views of relevant elements of another alternative pitch drive mechanism, FIG. 6A is an end view of relevant elements of an alternative roll drive mechanism, and FIG. 6B is an end view of relevant elements of another roll drive mechanism.

DETAILED DESCRIPTION OF THE INVENTION

Figure 1A:
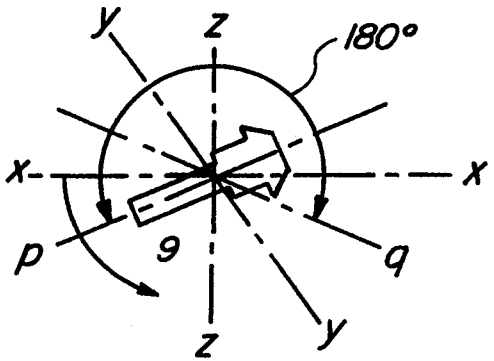
Figure 1:
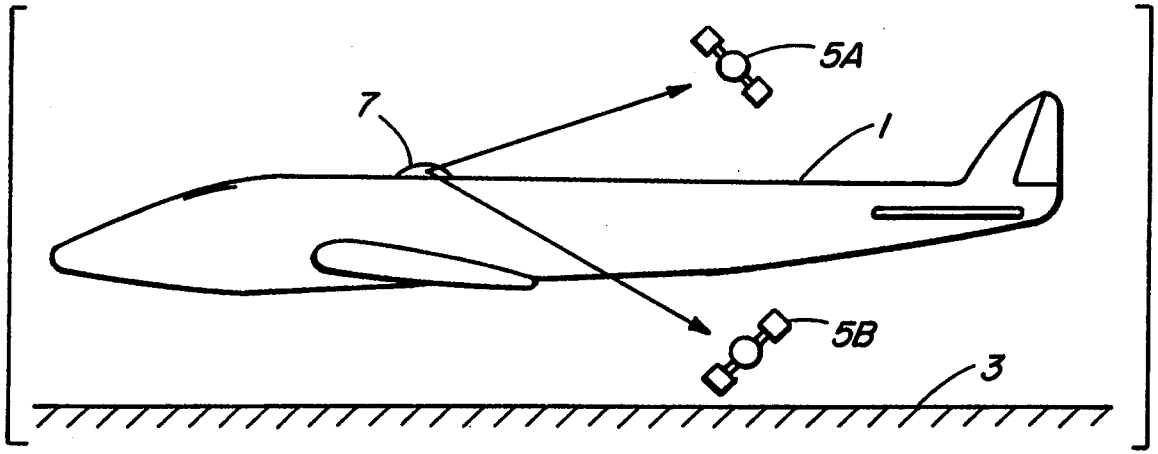

Turning to FIG. 1, an aircraft 1 is illustrated, flying above the earth, the horizon 3 of which is illustrated. It is desired to transmit or receive to and from earth satellite 5A or 5B.

Satellite 5A is above a plane parallel to the wings of the aircraft while satellite 5B is below that plane, the plane being parallel to a plane passing through a directional communications antenna, assuming the antenna is mounted on the top of the aircraft. A directional communications antenna carried within radome 7 is used to communicate with the satellite. It may be seen that to communicate with satellite 5B, the antenna must be able to be rotated in any azimuth direction and over elevational angles in excess of 180°.

FIG. 1A illustrates the problem. A helical antenna 9 is located on a three dimensional set of axes x, y, z, the axes being denoted by dash-dotted lines. The antenna 9 must be able to be pointed through 360° about the z axis, and over an angle in excess of 180° in those positions, shown for example by the arrowed line between dashed lines p and q in the x-z plane.

Figure 3:
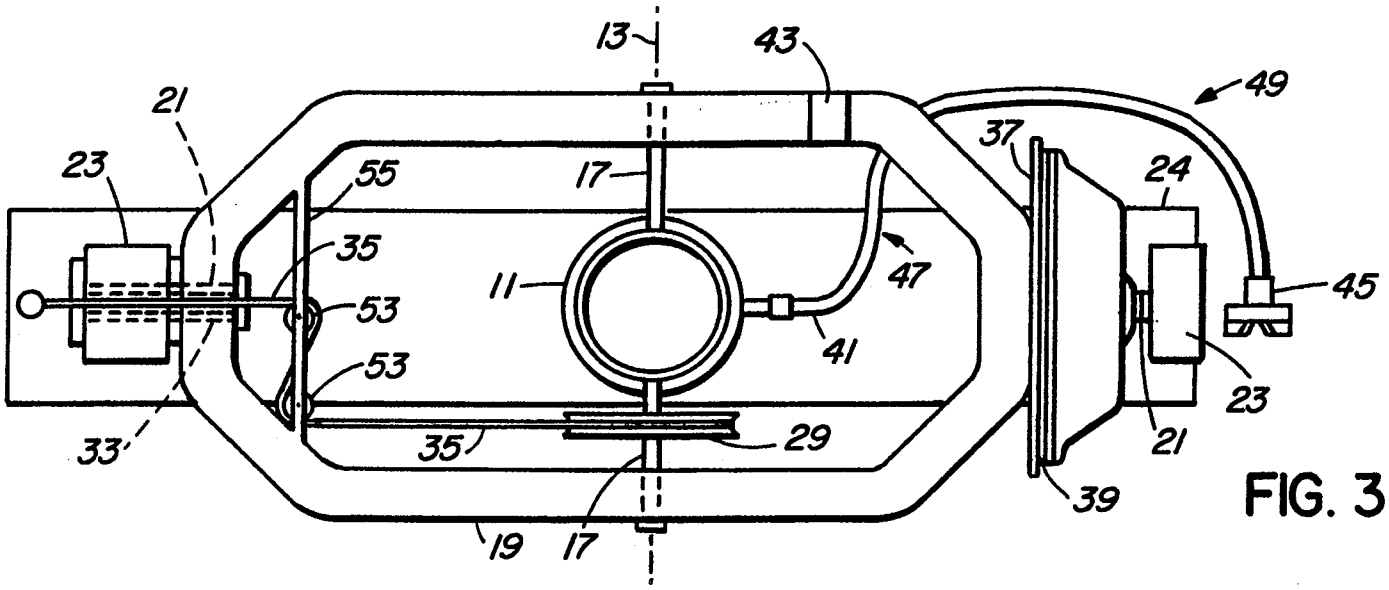
Figure 2:
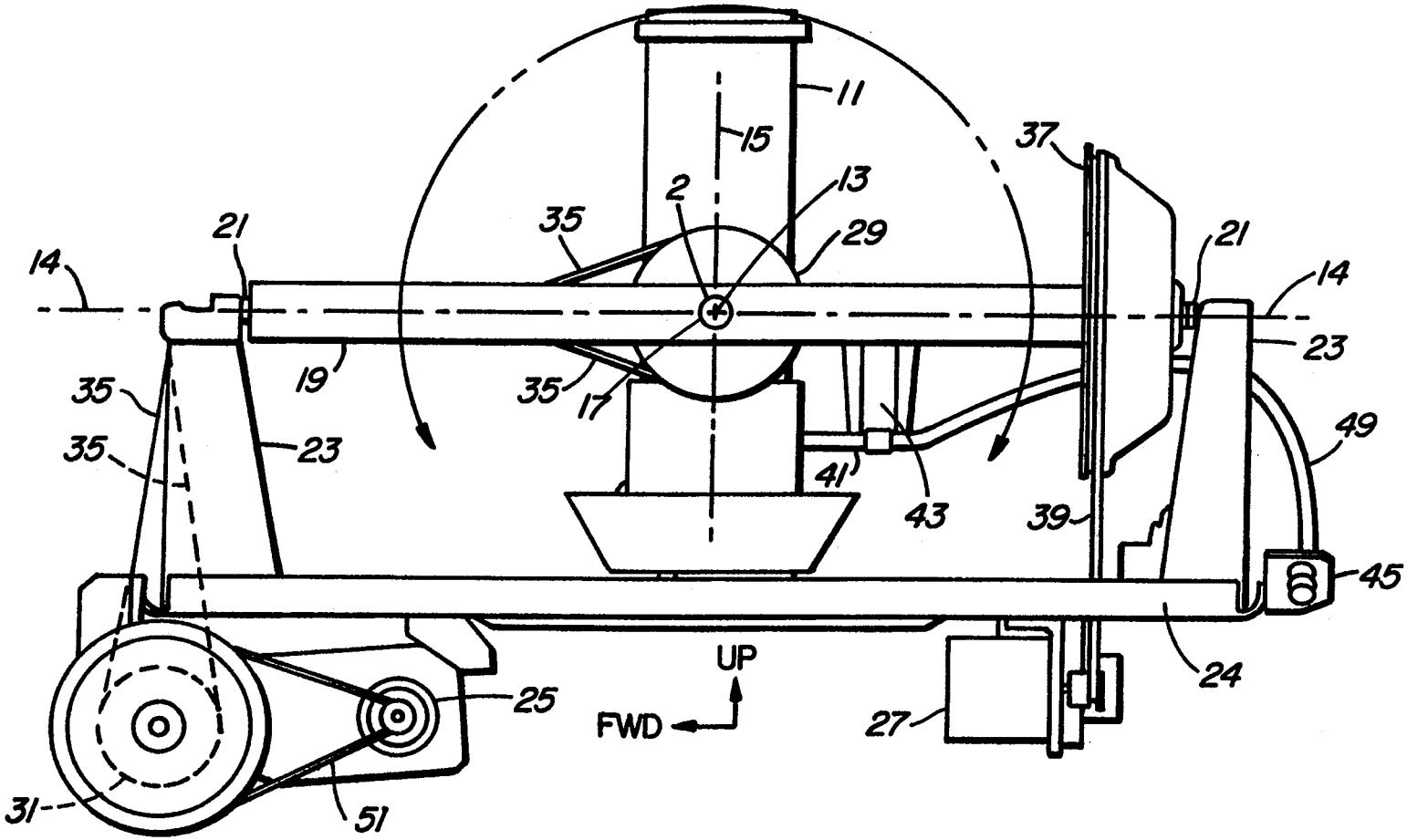

A preferred embodiment of the present invention is illustrated in side view in FIG. 2 and top view in FIG. 3. A highly directional antenna such as a helical antenna 11 is pivoted about a pitch axis 13 which is orthogonal to the central axis 15 of the antenna. The mass of the antenna should be approximately, preferably exactly, evenly distributed on either side of the pitch axis. Indeed it is preferred that the pitch axis should intersect the center of mass of the antenna.

The antenna is supported by coaxial axles 17 which are supported on an encircling yoke 19. The yoke is supported at its ends along a roll axis 14 by bearings 21 which are contained in and are supported by pylons 23. It is preferred that approximately equal mass of the yoke should be on opposite sides of axles 17.

Thus it may be seen that the yoke can rotate about its bearings carrying the axles 17 with it, rotating the antenna about the roll axis, and antenna 11 can also rotate about pitch axis 13.

The yoke 19, axles 17 and pylons 23 should be formed of substantially electromagnetically transparent material, preferably fiberglass. It is preferred that for the typical frequencies of interest, the filler in the fiberglass should be chopped KEVLAR TM fiber in an electromagnetically transparent epoxy for the frequenies of interest. It should be noted that in this specification the term "fiberglass" is meant to denote fiber reinforced expoxy, preferably KEVLAR TM fiber reinforced epoxy.

It may be seen that with the antenna 11 rotating about the pitch axis 13 and the yoke 19 rotating about roll axis 14, the antenna can be pointed through 360° in azimuth and in excess of 180° in elevation. While the bearings may be metallic e.g. formed of brass, they are typically so small to have negligible effect on the electromagnetic energy in the unusual condition in which the antenna is pointing directly at them.

The pylons 23 are supported on a base 24. On the side of the base opposite the antenna a pitch control motor 25 and a roll control motor 27 are located.

A first substantially electromagnetically transparent pulley 29 is mounted on an axle 27. A second pitch drive pulley 31 is mounted close to motor 25.

One of the bushings 21 contains a polished hole 33. An electromagnetically transparent cord is looped around both pulleys 29 and 31, passing through the polished bushing 33. The pulley 31 is driven by motor 25.

A third electromagnetically transparent pulley 37 is fixed to the yoke, and is mounted coaxially with the rotational axis of the yoke 19 on the opposite side of the bushing 21 containing hole 33. A toothed belt 39 is looped around pulley 37, through a hole, holes or slot in base 24, to the motor 27 from which it is driven by a bushing, pulley or the like.

Motors 25 and 27 are preferably stepper motors. The stepper motors are connected to a computer which is used for precisely positioning the directional axis of the antenna which circuit is not part of the present invention. The stepper motor 25, driving pulley 31 by means of a belt or cord loop 51, drives cord 35 which passes through the polished hole 33 in bushing 21, cord 35 looping around pulley 29. In order to align the cord from the plane of pulley 29 with the axis of bushing 33, a pair of guides 53 are supported by a non-metallic electromagnetically transparent rod 55 which extends across the yoke 19. Because the force transmitting element is a cord, it may be routed along paths which are not in the same planes as the pulleys 29 and 31, which planes need not be coincident.

Stepper motor 27, in rotating, rotates toothed belt 39 around pulley 37, which rotates the yoke 19.

Antenna cable 41 is connected to one end of the antenna. It is preferred that the cable should be fixed to the yoke 19 by means of a standoff 43. As shown in FIGS. 2 and 3, the other end of the cable is connected to a connector 45 which is fixed to the base 24. The cable should contain a loop 47 between the standoff 43 and the antenna and another loop 49 between the standoff and the place where it is fixed to the base, e.g. at connector 45.

With the rotation of pulley 29, the antenna 11 is rotated in pitch, and rotation of pulley 37 rotates antenna 11 in roll. With these rotations, the cable loops 47 and 49 vary in size to take up slack or to provide sufficient cable so that the movement of the yoke and the antenna will not be impeded.

It may be seen that with the yoke being supported at both sides, vibration will not allow bending thereof which would otherwise cause the antenna to change direction. Should bending stress against the yoke occur due to momentum involving the mass of antenna 11, both yoke bearings will act as pivots, thus cancelling out rotation of the antenna caused by strain in the yoke. Because the antenna 11 is supported from axles 17 at about its center of mass, and because axles 17 are supported with about equal mass of the yoke on opposite sides, no matter which direction the antenna points in, there will be substantially no resulting turning torque on the antenna which would cause change in pointing direction.

Because in this embodiment all of the elements above the base 24 are electromagnetically transparent, with the exception of the small sized yoke bearings 21 and the possible exception of small bearings in yoke 19 for axles 17, substantially no disturbance to the transmission of electrical energy is observed as the antenna is rotated.

With the width of base 24 preferably narrower than the length of the antenna, but even if it is not narrower, not only can the antenna rotate about the roll axis through an angle in excess of 180° but it can also rotate about the pitch axis through an angle in excess of 180°, without substantial disturbance to the transmission or reception of electromagnetic energy.

Figure 4B:
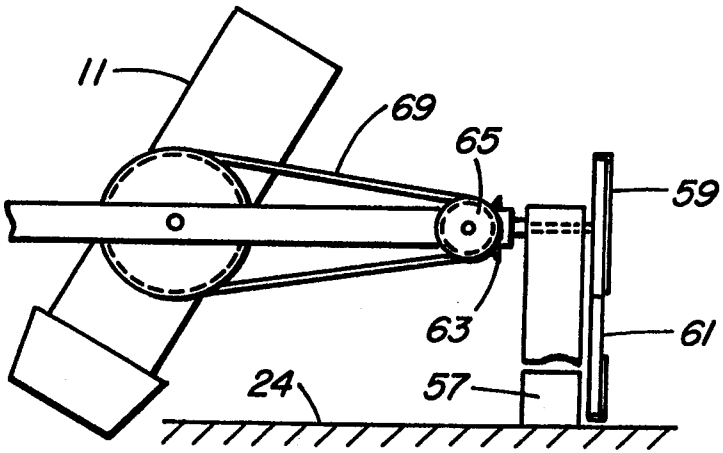
Figure 4C:
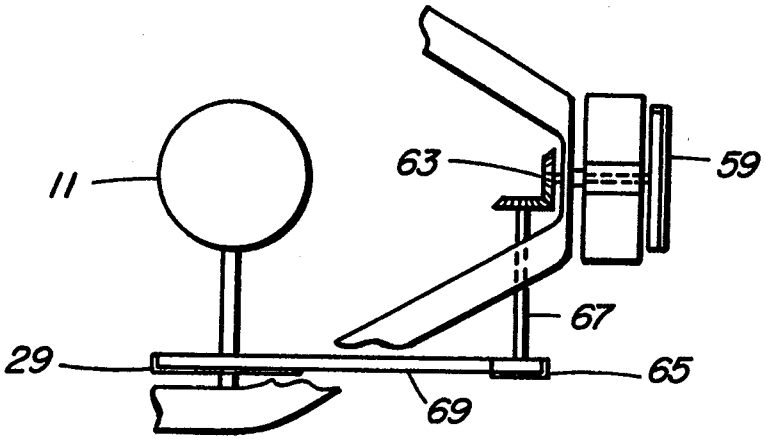
Figure 4A:
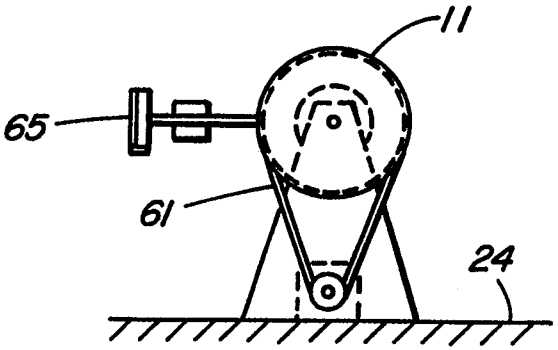

Referring now to FIGS. 4A, 4B and 4C, an alternative pitch drive mechanism is illustrated. A motor 57 is shown in this case mounted above and to base 24, although it could be located below base 24 with holes or slots contained in base 24 to accommodate a belt. The motor 57 drives a pulley 59 by means of a toothed belt 61. An axle driven by pulley 59 drives a bevelled gear mechanism 63 which translates rotary motion of pulley 59 to pulley 65 by means of shaft 67. Another toothed belt 69 drives pulley 29 from pulley 65.

Figure 5B:
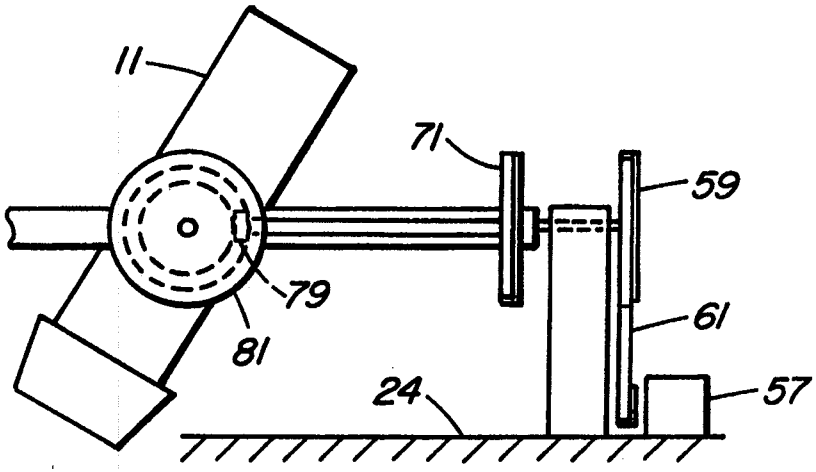
Figure 5C:
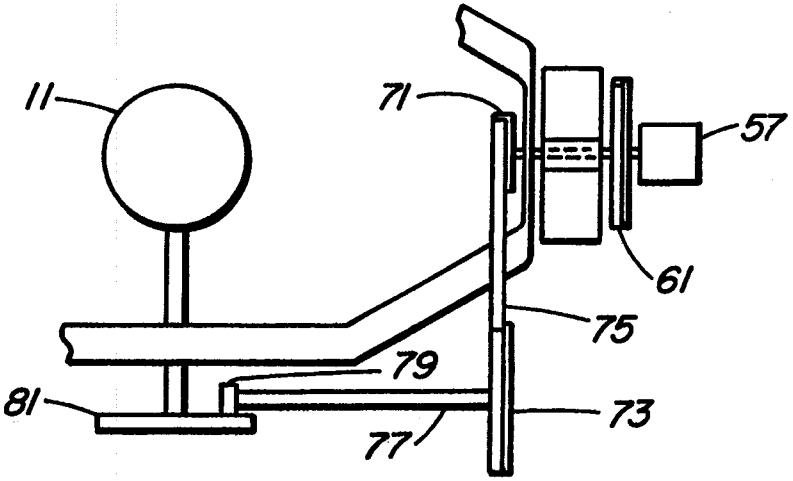
Figure 5A:
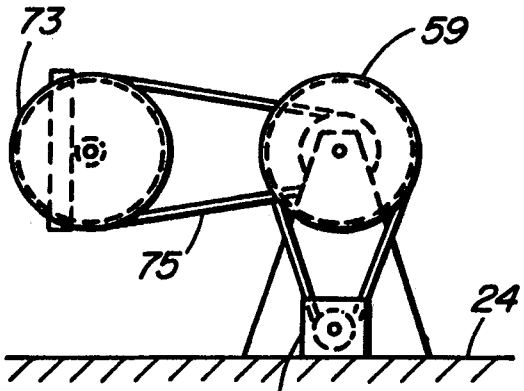

FIGS. 5A, 5B and 5C illustrate another alternative pitch drive mechanism, comprised of a toothed belt drive combined with a face gear on the pitch axis. Rather than pulley 59 driving a bevelled gear mechanism as in the embodiment of FIGS. 4A, 4B and 4C, it drives another pulley 71 which is coupled to a pulley 73 by means of a toothed belt 75. A shaft 77 extending from pulley 73 drives a small diameter gear 79 which meshes with teeth on the face of gear 81. Gear 81 is used in place of pulley 29, and drives the antenna about its pitch axis.

Figure 6A:
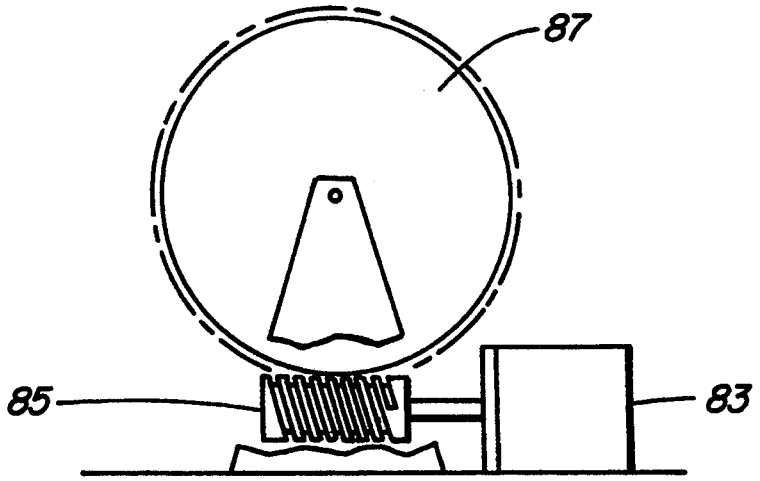

FIG. 6A is an end view of an alternative roll axis drive mechanism. A motor 83 has a worm gear 85 at the end of its shaft, which meshes with gear 87 which is used in place of pulley 37.

Figure 6B:
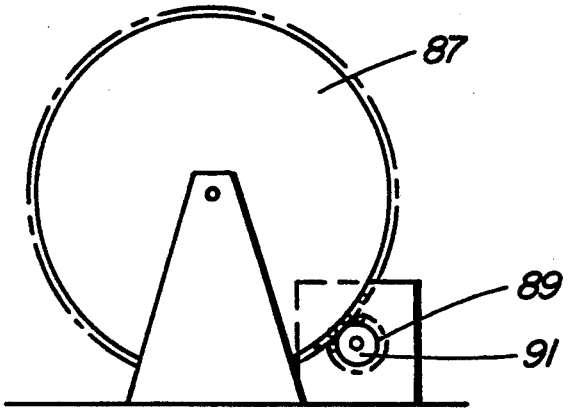

FIG. 6B illustrates another alternative roll axis drive mechanism. A motor 89 has a small gear 91 at the end of its shaft which meshes directly with gear 87 which is used in place of pulley 37.

In the embodiments shown in both of FIGS. 6A and 6B rotation of the motors 83 and 89, which are preferably stepper motors, causes rotation of the yoke 19, causing rotation of the antenna around the roll axis 14.

It is preferred that the material of the pulleys, gears and base used should be chopped KEVLAR TM filled fiberglass, and the toothed belts and cord used should be formed of KEVLAR TM .

The choice of drive configuration for each axis will be dependent on many factors, which include the degree of transparency of the mechanism to the antenna signals as well as mechanical considerations of friction, backlash, lubrication, over-all size and weight, as would be required for the particular design undertaken.

A person understanding this invention may now conceive of alternative structures and embodiments or variations of the above. All of those which fall within the scope of the claims appended hereto are considered to be part of the present invention.

I claim:

1. An antenna pointing mechanism comprising:
(a) a directional antenna having a central axis,
(b) first means for supporting the antenna about a pitch axis which is orthogonal to the central axis and which passes through about the center of mass of the antenna,
(c) an electromagnetically transparent yoke surrounding the antenna for supporting the first means,
(d) means for rotatably retaining the yoke at opposite ends thereof at positions along a roll axis,
(e) first independent substantially electromagnetically transparent driving means for driving the antenna to rotate about the pitch axis, and
(f) second independent substantially electromagnetically transparent driving means for driving the antenna to rotate about the roll axis.

2. A mechanism as defined in claim 1, in which the antenna is an elongated spiral antenna.

3. A mechanism as defined in claim 2, in which said first and second driving means include means for rotating the antenna about said roll and pitch axes respectively over an elevational angle in excess of 180°.

4. A mechanism as defined in claim 3 in which said first means is comprised of a pair of axles fixed to opposite sides of the antenna and rotatably supported by the yoke, and in which said first driving means is comprised of a pitch control motor fixed at a position below the antenna, and means for coupling the pitch control motor to the antenna.

5. A mechanism as defined in claim 4, further including an antenna cable fixed to the antenna, standoff means for fixing the cable to the yoke, means for fixing the cable to the base, the cable containing a pair of loops, one between the standoff and the means for fixing the cable to the base and the other between the standoff and the antenna, whereby upon pitch rotation of the antenna said other loop increases or decreases in size and upon roll rotation of the antenna said first loop increases or decreases in size.

6. A mechanism as defined in claim 4, in which the coupling means is comprised of a first substantially electromagnetically transparent pulley mounted on an axle, a small pulley, a bevel gear mechanism coupling the pitch control motor to the small pulley, and a toothed belt coupling the small pulley and said first pulley.

7. A mechanism as defined in claim 4 in which the coupling means is comprised of a face gear mounted on an axle, a small gear meshed with the face gear, an axial shaft extending from the small gear, a pulley mounted on the axial shaft, and a toothed belt coupling the pitch control motor to the pulley mounting on the axial shaft.

8. A mechanism as defined in claim 3, in which said first means is comprised of a pair of axles fixed to opposite sides of the antenna and rotatably supported by the yoke, and in which said first driving means is comprised of a first substantially electromagnetically transparent pulley mounted on an axle, a pitch control motor fixed at a position below the antenna, and an electromagnetically transparent cord coupling the pitch control motor to the pulley.

9. A mechanism as defined in claim 8 in which said means for retaining the yoke is comprised of a base, and a pair of pylons extending orthogonally to the base, the yoke being rotatably suspended and retained by yoke bearings contained in the pylons.

10. A mechanism as defined in claim 9 further including a polished bushing hole extending through the center of one of the yoke bearings, a second pitch drive pulley adjacent the pitch control motor and driven by the pitch control motor, said cord being in the form of a loop passing around both said pitch drive pulley and said first pulley, and passing through the polished bushing hole.

11. A mechanism as defined in claim 10, including guides fixed to the yoke for guiding the cord from said first pulley to an entrance to the polished bushing hole.

12. A mechanism as defined in claim 10, in which the pitch control motor and the pitch drive pulley are mounted on the opposite side of the base than the yoke.

13. A mechanism as defined in claim 12, further comprising a roll control motor mounted on the opposite side of the base than the yoke, a third roll control pulley being fixed to the yoke and having an axis of rotation coaxial with said roll axis passing through the yoke bearings, and a belt coupling said third pulley and the roll control motor for coupling rotational force from the roll control motor to the yoke, the axles, and the antenna.

14. A mechanism as defined in claim 13 in which the motors are stepper motors adapted to precisely position the pointing direction of the antenna relative to the base.

15. A mechanism as defined in claim 14, further including an antenna cable fixed to the antenna, standoff means for fixing the cable to the yoke, means for fixing the cable to the base, the cable containing a pair of loops, one between the standoff and the means for fixing the cable to the base and the other between the standoff and the antenna, whereby upon pitch rotation of the antenna said other loop increases or decreases in size and upon roll rotation of the antenna said first loop increases or decreases in size.

16. A mechanism as defined in claim 1 in which the second driving means is comprised of a circular gear fixed to the yoke coaxially with the roll axis, a motor having its axis orthogonal to the roll axis, and a worm gear fixed to a motor shaft coupled to the circular gear for driving the circular gear and thus rotating it and the yoke.

17. A mechanism as defined in claim 1 in which the second driving means is comprised of a circular gear fixed to the yoke coaxially with the roll axis, a motor having its axis parallel to the roll axis, and a small gear fixed to a motor shaft coupled to the circular gear for driving the circular gear and thus rotating it and the yoke.

18. A mechanism as defined in claim 1, in which the means for retaining the yoke is mounted on one side of a base, and further comprising a roll control motor mounted on the opposite side of the base than the yoke, a roll control pulley being fixed to the yoke and having an axis of rotation coaxial with said roll axis passing through the yoke bearings, and a belt coupling said pulley and the roll control motor for coupling rotational force from the roll control motor to the yoke, the axles, and the antenna.

19. A mechanism as defined in claim 1, in which the first and second driving means include a pitch drive motor and a roll drive motor respectively, said motors being stepper motors.

20. An antenna pointing mechanism comprising:

(a) directional antenna having a central axis, (b) first means for supporting the antenna about a pitch axis which is orthogonal to the central axis, (c) an electromagnetically transparent yoke surrounding the antenna for supporting the first means, (d) means for rotatably retaining the yoke at opposite ends thereof at positions along a roll axis, (e) first independent substantially electromagnetically transparent driving means for driving the antenna to rotate about the pitch axis, and (f) second independent substantially electromagnetically transparent driving means for driving the antenna to rotate about the roll axis.

* * * * *